US005788527A

United States Patent [19]

Sanders et al.

[11] Patent Number: 5,788,527

[45] Date of Patent: Aug. 4, 1998

[54] ELECTRICAL CONNECTOR WITH IMPROVED SAFETY LATCHING FOR A FLUORESCENT-LIGHTING BALLAST

[75] Inventors: Stuart E. Sanders, Brandon, Miss.; Raymond H. Van Wagener, Darien, Conn.; Fred P Bauer, Mendenhall; Mark R. Opperthauser, Jackson, both of Miss.

[73] Assignee: MagneTek, Inc., Nashville, Tenn.

[21] Appl. No.: 960,711

[22] Filed: Oct. 30, 1997

Related U.S. Application Data

[63] Continuation of Ser. No. 509,995, Aug. 1, 1995, abandoned, which is a continuation-in-part of Ser. No. 224,811, Apr. 8, 1994, Pat. No. 5,488,268, which is a continuation-in-part of Ser. No. 9,645, May 14, 1993, Pat. No. 5,350,316, which is a continuation-in-part of Ser. No. 680,699, Apr. 4, 1991, Pat. No. 5,260,678.

[51] Int. Cl.[6] ..... H01R 13/627

[52] U.S. Cl. ..... 439/352; 439/357

[58] Field of Search ..... 439/352–354, 439/357, 358

[56] References Cited

U.S. PATENT DOCUMENTS 5,389,007 2/1995 Reinelt ..... 439/357

*Primary Examiner*—Gary F. Paumen

*Attorney, Agent, or Firm*—Waddey & Patterson; Mark J. Patterson

[57] ABSTRACT

One half-connector terminates leads in the ballast, carrying electricity to and from the ballast coils. Another half-connector terminates leads outside the ballast, connected e. g. to carry power to lamp sockets. A hook extended from a first of the half-connectors engages a catch formed in a second. A retaining surface, preferably associated with the second half-connector, keeps the hook engaged with the catch. Preferably the space between the retaining surface and the catch is smaller than the unstressed dimension of the hook barb—but during the act of engagement the barb deforms to pass between the catch and surface; then the barb springs back into shape and is held behind the catch. In this process also preferably the retaining surface cooperates with the first half-connector to support the shaft or beam of the hook at both ends—as in a classical double-ended beam spring structure, contrasted with a cantilevered spring in a conventional hook and catch. A ramp guides the hook between the catch and surface even if the hook has been warped before assembly, at least in commonly occurring modes of warping.

12 Claims, 10 Drawing Sheets

ELECTRICAL CONNECTOR WITH IMPROVED SAFETY LATCHING FOR A FLUORESCENT-LIGHTING BALLAST

This application is a continuation of application Ser. No. 08/509,995 filed Aug. 1, 1995, now abandoned; which is a continuation-in-part of U.S. Ser. No. 08/224,811 filed Apr. 8, 1994 now U.S. Pat. No. 5,488,268 issued Jan. 30, 1996 which is a continuation-in-part of Ser. No. 08/009,645 filed May 14, 1993, now U.S. Pat. No. 5,350,316 issued Sep. 27, 1994; which is a continuation-in-part of Ser. No. 07/680,699 filed Apr. 4, 1991, now U.S. Pat. No. 5,260,678 issued Nov. 9, 1993.

The patent documents just listed are, in their entireties, incorporated by reference into this present document.

BACKGROUND

1. Field of the Invention

This invention relates generally to fluorescent-lighting fixtures; and more particularly to an improved safety latch for electrical connections in such fixtures.

2. Prior and Related Art (a) Problems particularly addressed by earlier patent documents in this series—The working parts of fluorescent fixtures, sometimes called "luminaires", constitute a difficult field characterized by extremely high sales volumes, low unit prices and extremely competitive pricing. These factors magnify differences of a fraction of a cent in component cost, assembly time, and inventorying or shipping efforts—and relatively small differences in installation convenience—into major concerns.

Traditionally transformers or "ballasts" for fluorescent fixtures were made with protruding electrical leads for individual connection to the fixture wiring by installation personnel. That work was done, either in the fixture factory or (especially for replacement ballasts) in the field, using individual, manual splicing techniques such as wire-nut splicing.

The evident labor-intensiveness of such procedures, as well as inventory ramifications, have led the industry in recent years to introduce the so-called "leadless" ballast. Such a ballast has an associated electrical half-connector, which is sometimes (but not necessarily) mounted to or in the wall of the ballast housing.

The ballast-associated half-connector terminates all or la nearly all the leads from the electrical windings which are within that housing. A mating half-connector terminates the leads from lamp sockets that form part of the luminaire, so that the electrical-connection part of the installation process may be reduced to simply plugging one half-connector into the other.

In most leadless-ballast configurations the two incoming power leads are also wired through this same connector. In some configurations those two leads, or for instance special sensing or control-signal leads, may be handled separately.

Strain-relief provisions for each lead, at both sides of the connector, are essentially a requirement in the fluorescent-lighting industry as they are required for approval by safety-certifying organizations such as the Underwriters Laboratories®. Strain relief is more important in this field than in most consumer-product industries because ballasts are very heavy and luminaires are typically mounted overhead; if the mechanical connections of a ballast are not completed properly, the wiring provides a last-ditch backup against potentially severe injury or property damage below.

Most typically all the male terminals or contacts are held in one of the two half-connectors—usually and preferably the ballast-associated half, but sometimes the fixture-associated half. Correspondingly the female contacts are held in the other half-connector (i. e., usually but not necessarily the fixture-associated half).

In principle, male contacts can be used for some leads and female contacts for other leads within each half-connector, but this is not popular in the industry. At any rate each contact typically is held within its own respective through-hole, formed fore-to-aft through the half-connector.

A favored type of contact, particularly for the female contacts, in leadless-ballast connectors is the well-known rolled sheet-metal variety that has outward-biased retaining tangs. During contact installation (forward insertion from the rear of the half-connector) the tangs are compressed radially inward—generally into line with the cylindrical rolled body of the contact—allowing the contact to pass forward through a cylindrical inner surface of an inner flange or ledge, molded as part of the interior surface of the through-hole.

After passing through the flange, the tangs spring outward radially so that their tips can bear longitudinally against the annular surface of the flange or ledge: the annular ledge thus serves as a tang stop. In this way the tangs and ledge cooperate to prevent the contact from escaping rearward from its through-hole.

Contacts of this configuration can be used for the male pins as well. In the interest of economy, however, some commercial configurations instead simply use the bared ends of the electrical leads—i. e., bared wire ends—as the male contacts.

A male contact of this type is extremely attractive because it is essentially free of material, installation and handling costs. The very slight additional length of wire substitutes entirely for a rolled or other formed male pin, thus eliminating entirely the cost of a formed pin; and the bared-wire-ends technique adds at most a minor coining and tapering of the cut tips.

The wires whose ends are bared may be held in the half-connector through-holes using adhesive, or slug locks as described in the parent patent documents identified earlier, or by other sideways-driven wedging devices, or by ultrasonically fusing material of the half-connector with insulation adjacent to the bare wire ends, or through other fastening techniques.

Unfortunately, until recently the economic appeal of such bared-wire-end contacts was not fully met in practice, for they do not engage the female contacts as reliably. The reason is that the bare-end contacts are typically less rigid than, and lack the bullet nose or profile of, the rolled sheet-metal contacts.

During contact installation or handling, before mating of the two half-connectors to install the ballast, the tips of the bared wire ends are somewhat more susceptible to bending away from a nominal straight-in-line position relative to the through-hole. Such bent, untapered ends fail to pass smoothly into the female contacts.

The tantalizing economies of the bare-wire-end contact place a premium on effective but inexpensive provisions for reinforcing or recentering the male-contact tip or otherwise guiding it into its respective female contact. What is needed is an effective but inexpensive provision.

Standard female contacts do have a forward-facing bell intended to help capture male-contact tips that are only slightly off-center. The bell diameter, however, is severely limited—by the requirement that the bell, as well as the rest of the female contact, must pass through the small-diameter internal flange or tang stop.

Because the diameter of the bell must be so small, while it may be adequate for the small amount of out-of-line deformation likely to occur in a relatively strong rolled-metal pin it is inadequate for the greater deformation that often occurs in a relatively weaker bared-wire-end male contact. The overall result is that the standard-size bell is ineffective: the contacts fail to engage.

In theory a larger-diameter centering bell can be provided if the female contact is inserted rearward into its through-hole from the front of the half-connector, rather than forward from the back. This technique, however, requires threading each wire, too, rearward through the hole, in advance of the contact—and only after that making the connection of the opposite end of that wire with its socket, winding, etc.

This threading operation is very time consuming, and the associated sequence of operations (socket or winding connection after threading) is relatively awkward. Thus use of a large-bell female contact would generate added costs—possibly even high enough to negate the savings of the bared-wire-end contacts—and is unacceptable.

(b) Solutions introduced by the earlier patent documents in this series—The immediate parent or precursor of this present patent document, first-mentioned in the enumeration of parent documents above, teaches how to overcome these problems. Each female terminal is positioned in a longitudinal through-hole in the external connector body; a necked-down section is formed in each through-hole forward from the female terminal; and preferably a funnel is formed in the frontal face of the necked-down section.

Also preferably the preformed bore of each through-hole rearward from the necked-down section is at its broadest immediately behind the necked-down section. Accordingly no internal flange or ledge can be provided, and the female terminal is not retained by the common tang-and-ledge arrangement but rather by breaking-in or fusing-in a portion of the half-connector body to jam or otherwise lock the terminal, or preferably its attached lead, or both, to the body. Strain relief is thereby provided in conjunction with simple retention of the terminal.

The grandparent and great-grandparent, or earlier precursors, of this present patent document, also mentioned in the enumeration earlier in this document, teach numerous other innovations and refinements in the art of leadless ballasts. For example they teach details of the process of breaking or fusing a portion of the wall of the half-connector body, for purposes of achieving strain relief.

Those documents also teach an extraordinarily economical and simple ear-and-slot configuration for hanging the internal half-connector in the ballast enclosure preparatory to potting the entire ballast contents. In addition, they teach preferable incorporation of a very important feature, namely a safety latch that holds the two half-connectors very firmly together.

This safety latch is potentially of the utmost importance in event the ballast should be inadequately secured to its luminaire at initial assembly—or should later become loose in its attachment due to vibration, or due to improper working procedures of maintenance personnel, or other causes. In such cases the ballast may come to be hung from the luminaire by its electrical connections alone, and thus by the latch.

This last connection thread may prevent severe injury or damage below, long enough to enable proper repair. A latch gives high extraction force with rather low insertion force.

(c) Problems addressed by the present invention—We have discovered, however, that under certain circumstances the safety latch may be effectively disabled before installation in a luminaire. In principle such a condition should be detected by inspection before installation, and can be felt by assembly workers during installation.

In practice, however, as will shortly be explained the disablement may occur while the external half-connectors are in storage after inspection. Furthermore, assembly personnel may overlook such a condition, for a relatively small deformation of certain plastic parts is all that is needed to render the latch inoperative. Also the engagement (or failure of engagement) of the latch with its mating catch in the internal half-connector is concealed within that internal half-connector and so cannot be readily seen.

Moreover the snap-in action (or its absence) of the latch, engaging with its mating catch, might not be felt. The reason is as follows. Many assembly workers find that multiple repetitive installations of the two half-connectors present just enough force trauma to induce carpal-tunnel syndrome and like problems. Such problems have led to design and use of a special assembly tool, which provides a high mechanical advantage in the insertion step to alleviate wrist strain.

Of course such isolation of the assembly worker from the force of the latch action is beneficial for purposes of the worker's health, and this is very important. At the same time it also isolates the worker from much of the characteristic vibration of the latch action.

(d) Detailed operation of the connector introduced by the earlier patents in this series—FIG. 10 shows in longitudinal section, along a central plane, the connector that has been in use with leadless ballasts disclosed in the earlier patent documents enumerated above. As to the external half-connector 10, the drawing shows just one bore 12-11-14 for receiving a single electrical terminal—but typically multiple other bores are formed parallel to the illustrated one, and respectively disposed some behind and some in front of the plane of the drawing.

The half-connector body 10 is of a preferred type which has no ledge for engagement of a radially expanding locking tang from a female terminal. Instead the body 10 preferably has a funnel-shaped forward face 14, defined in a necked-down section at the front of the body and leading to a narrow orifice on the axis of the body.

Rearward from that necked-down section or orifice is preferably a main segment of a bore 11 for holding a terminal. The terminal itself is not shown, but ideally is a female terminal as explained earlier—and is installed through a rear port 12.

Preferably the bore 11 is at least as broad (e. g. at least as great in diameter) throughout its length as it is immediately behind the necked-down section and orifice. That is to say, the narrowest part of the bore is at the front, just behind the funnel-shaped constriction.

The external half-connector 10 is configured for insertion into the internal half-connector body 130. The latter has a mouth segment 131, whose height is just greater than the height B of the body 10, and then a slightly shallower throat as shown.

The forward part of the external half-connector body 10 preferably is furcated into individual-contact-holding fingers or extensions 13. These fingers parallel the central one that is shown in FIG. 10, and each finger holds one of the parallel bores mentioned above. The illustrated lesser height of the finger segment 13 fits into the shallower throat of the internal body 130.

As the earlier patent documents explain and illustrate in greater detail, this arrangement facilitates use of voltage-guarding membranes (not shown) in the internal half-connector. Such membranes help to isolate the terminals within the parallel bores against high-voltage arcing.

This type of external half-connector body is illustrated here only because it is the type which we prefer, for various benefits that are explained in the earlier patents and briefly mentioned above. As will be appreciated upon study of the remainder of this document, however, the present invention is entirely capable of practice with an external half-connector body whose internal configuration is more conventional.

For instance, such a more-conventional configuration may include an interior flange or ledge for retention of an expanding terminal tang. The principal benefits of the present invention are conferred upon any such more-conventional assembly.

Features of particular interest to the present invention include a hook 20–25, with a main deflection point 15 just adjacent to a support arm 16. The arm 16 is held relatively rigid, with respect to the body 10, by a thin stabilizing vane 17. The hook 20–25, arm 16 and stabilizer 17 are molded integrally with the half-connector body 10.

Due to the stabilizing effect of the vane 17, most of the deflection and movement of the hook are in the beam portion 25 and particularly at the main deflection point 15—but with very important deformations occurring in the barb 20 of the hook as will be seen. The beam 25 is elongated generally along the direction of insertion, though nominally angled downward at a few degrees below horizontal as shown, and has substantially parallel upper and lower surfaces.

The barb 20 includes five main parts: a top surface 21, which when the hook is unstressed is straight and roughly parallel with the beam section 25; a relatively sharp frontal tip 22, an angled bottom-frontal cam 23, a short and very shallowly angled heel 24, and a steeply angled undercut rear anchor face joining the heel 24 to the underside of the beam 25. (In preferred practice the top surface 21 is angled upward by a few degrees relative to the top of the beam section, but as will be seen this detail is not significant is with respect to the present invention.)

Formed in the internal half-connector body 130 is a secondary chamber 132 for receiving the barb 20. This chamber 132 is adjacent to the main mouth 131 but preferably separated from it by at least a thin partition 136. (For purposes of illustration only, the partition is here drawn disproportionately thin, relative to the other elements.)

At the outer edge of this chamber the body defines a catch 133 with an undercut anchor surface 134. This latter surface lies at roughly the same angle as the undercut rear anchor face of the barb 20, and engages that face and the heel 24 of the barb to secure the two half-connectors together.

When the external half-connector body 10 is advanced toward engagement with the internal half-connector body 130, if the hook is in its nominal condition as illustrated, interaction of the two bodies proceeds generally as shown in FIGS. 11 through 13. The first contact of the hook 120–125 with the internal body 130 is made by the cam 23, engaging the rounded upper and outer corner of the catch 133 as seen in FIG. 11.

With further advancement of the external body 10 the cam 23 rides up that outer corner of the catch 133 as FIG. 12 shows. As seen, substantially all of the compliant hook deformation needed to accommodate this motion occurs in the beam 25—mostly near the main deflection point 15 of FIG. 10 but in some cases distributed along a greater fraction of the beam 25, particularly as advancement continues.

Naturally the beam compliance is accompanied by spring action that opposes the illustrated bending. Most typically the barb tip 22 does not touch the partition 136, at least once the main upper part of the external body 10 is fairly well aligned with the throat of the internal body 130.

After the cam 23 and heel 24 pass over the catch 133, the spring action of the beam snaps the hook back out to its nominal or in any event unstressed position. The beam 25 rests on, or biased by its own spring action against, the top surface of the catch 133—with the barb positioned well inside the secondary chamber 132, and the heel 24 well below the top of the catch 133. In particular the undercut rear face of the barb directly opposes and lies at very nearly the same angle as the likewise undercut interior face 134 of the catch 133.

By virtue of these two undercuts, the hook and catch tend to very firmly seat together, strongly opposing any extraction force. This is true even if such force is great enough to slightly deform the barb—and even if the unstressed shape of the beam 25 has been deformed slightly, before use, so that the beam does not quite touch the top of the catch 133.

The retention force is easily able to support the weight of the ballast, and can do so even with some additional force tending to separate the two bodies 10, 130. Such force might be developed by, for example, falling of the ballast away from the luminaire, far enough to dangle by the electrical wires attached to the external body 10. (As will be recalled, the wires themselves are very securely fastened to the external body 10 as by strain-relief provisions that involve breaking-in or fusing-in a portion of the wall of the body 10 to jam against or fuse with the insulation or terminal of each lead.)

Thus the safety-latching system operation is excellent, provided only that the unstressed position and shape of the beam 25 are reasonably close to nominal. We have discovered, however, that unfortunately this critical condition may be violated.

Sometimes, probably due to combined heat and pressure from adjoining heavy articles in storage (after inspection), the hook and particularly its beam 25 may be predeformed, warped, to assume a shape 25' more nearly as seen in FIG. 14. As is well known, plastic creeps under influence of continued force, as for example the force of gravity acting on an object that is resting on top of the half-connector. In the FIG. 14 case naturally the external body 10 may be advanced fully into engagement with the internal body 130 without any engagement of the latch at all.

In such a case the safety-latching system fails completely in its function, since as FIG. 15 illustrates clearly the beam is so distorted 25' that even the heel 24' of the barb is above the top surface of the catch 133. No part of the undercut rear face of the barb can touch the intended mating surface 134 of the catch 133.

The warping illustrated in FIGS. 14 and 15 is rather extreme, and in fact we have realized that failure of the safety-latching system can occur with much more moderate levels of deformation. In fact, even if the warped beam 25' is such that the heel 24' comes to rest somewhat lower—so that it does engage, along a small fractional part of its length, the mating catch surface 134—modest separation forces can deform the barb enough to slip out of the engagement.

Therefore full enjoyment of the potential safety and other benefits of a leadless ballast has not been possible heretofore. As can now be seen, important aspects of the technology used in the field of the invention are amenable to useful refinement.

SUMMARY

The present invention introduces such refinement, and enables secure safety retention of the ballast with its wiring even in event of severe beam deformation 25' such as shown in FIGS. 14 and 15. The invention has at least three independently usable facets or aspects, which will now be introduced.

These aspects or facets, however, do have several elements in common. The common parts will be described first.

In its preferred embodiments, the present invention is, a combination for use in a fluorescent-lamp fixture having lamp sockets. (The fixture itself, i. e. the luminaire, and its sockets are not part of the combination as defined in most of the appended claims—except for certain elements that are specifically recited below.)

The combination includes a ballast, and electrical equipment mounted within the ballast. The combination also includes a half-connector mounted to the ballast and connected electrically to the electrical equipment within.

The combination also includes electrical leads for extension through the fixture—substantially outside the ballast. It is to be understood that this wording encompasses some configurations in which the internal half-connector is recessed enough that the electrical leads may be regarded as slightly penetrating the ballast envelope.

The combination also includes another half-connector, terminating the electrical leads, for mating with the first-mentioned half connector to complete electrical interconnections between the electrical equipment and the electrical leads.

The combination also includes a hook extending from a first one of the two half-connectors. Further the combination includes a catch, formed in a second one of the two half-connectors, for engaging the hook to hold the two half-connectors together.

Now in preferred embodiments of a first of the independent aspects or facets of the invention, the combination still further includes a restraining surface, also formed in the second one of the two half-connectors, for holding the hook engaged with the catch.

The foregoing may be a description or definition of the first facet or aspect of the present invention in its broadest or most general terms. Even in such general or broad form, however, as can now be seen the first aspect of the invention resolves the previously outlined problems of the prior art.

In particular this combination is substantially free of the type of failure described in the preceding section of this document. A surface is provided to hold the barb 20 so that the undercut surfaces of barb 20 and catch 133 will properly seat, and the safety-latching system operates correctly as earlier described. This is accomplished without adding any physically discrete component, and without adding any cost.

Now we turn to a second of the independent facets or aspects of the invention. In preferred embodiments of this second facet, the combination includes a surface—also formed in the second one of the two half-connectors—for cooperating with the first one of the two half-connectors to suspend the hook as a double-supported deflecting beam.

More specifically, the surface suspends the hook, as a double-supported deflecting beam, or double-supported beam spring, against lateral force applied to the hook by the catch during engagement of the hook and catch.

The foregoing may constitute a definition or description of the second facet or aspect of the present invention in its broadest or most general terms. Even in such general or broad form, however, as can now be seen the second aspect of the invention resolves the previously outlined problems of the prior art.

In particular such a double-supported deflecting beam device presents stronger restoring force, tending to retain the barb engaged with the catch, than available with a cantilevered spring, i. e. single-end supported deflecting beam.

In this way this second facet of the invention too accommodates the undesired vulnerability of the beam structure to preassembly warping away from its nominal unstressed position and shape, and again (as will be seen) with no associated additional component or cost. Hence this facet of the invention too promotes and enables the desired safety that is desired in a leadless ballast.

In preferred embodiments of still a third main facet or aspect of the invention, the invention is a method. More specifically, it is a method for selectively securing together or separating two half-connectors that electrically interconnect electrical equipment of a fluorescent-lamp ballast with leads that are extended through the fixture substantially outside the ballast.

The two half-connectors—which are parts of the operating environment of the method—have respectively a hook, which includes an enlarged portion, and a catch that mutually interengages with the enlarged portion of the hook to hold the two half-connectors together. One of the half-connectors also has a restraining surface that is spaced from the catch.

The method itself comprises the step of inserting the hook between the catch and the restraining surface until the hook contacts either the catch or the restraining surface. The method also includes the step of then continuing to insert the hook—while the hook continues to contact either the catch or the restraining surface—until the hook also contacts the restraining surface or the catch, respectively.

Further the method includes the step of then continuing to insert the hook—with the hook still continuing to contact both the catch and the restraining surface—while the hook deflects to pass between the catch and the restraining surface. Further yet the method includes the step of then continuing to insert the hook until the enlarged portion of the hook passes the catch, and the enlarged portion of the hook engages and is held by the catch, to selectively secure the two half-connectors together.

Although preferred embodiments of the invention in each of its three major facets thus provide very significant advances relative to the prior art, nevertheless for greatest enjoyment of the benefits of the invention it is preferably practiced in conjunction with certain other features or characteristics which enhance its benefits. For example, although the three aspects of the invention may in principle be practiced separately, it is preferred that all three be used in mutual conjunction together.

Each half-connector has a half-connector body, for purposes of this document called the "internal connector body" and "external connector body" respectively. The internal connector body preferably has the form of an electrical receptacle, and is mounted to the ballast (most typically, but not necessarily, in the wall of a ballast enclosure), and terminates the above first-mentioned plurality of leads.

The external connector body preferably has the form, generally speaking, of an electrical plug or jack—for mating with the internal connector body—and terminates the above second-mentioned plurality of leads.

Further it is preferred that the combination of either of the first two main aspects of the invention further include spacing of the surface from the catch—along a direction transverse to the generally longitudinal extension of the beam—by a distance that is smaller than the transverse unstressed dimension of the barb. (Here it will be understood that the "beam" is a part of the hook and has a generally longitudinal extension, and that the "barb" too is a part of the hook and has an unstressed dimension generally transverse to that longitudinal extension—all as previously set forth and shown in the "RELATED ART" section of this document.)

It is also preferred that the hook deflect for passage of the barb between the catch and the surface. It is further s preferred that the combination include a ramp, also formed in the second one of the two half-connectors, for helping to guide the barb into alignment with the surface.

Also preferably the surface and the catch are offset, along the longitudinal direction, as well as being separated in a direction transverse to the longitudinal direction—and that, to engage the hook with the catch, the hook is inserted, generally along the longitudinal direction, between the catch and the surface.

As to the method, preferably it includes what may be called a "subprocedure" for selectively separating the two half-connectors. This part of the method includes the steps of manually squeezing the hook, deflecting the hook so that the enlarged portion of the hook can pass the catch; and then extracting the hook from between the catch and the restraining surface.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

Figure 1:
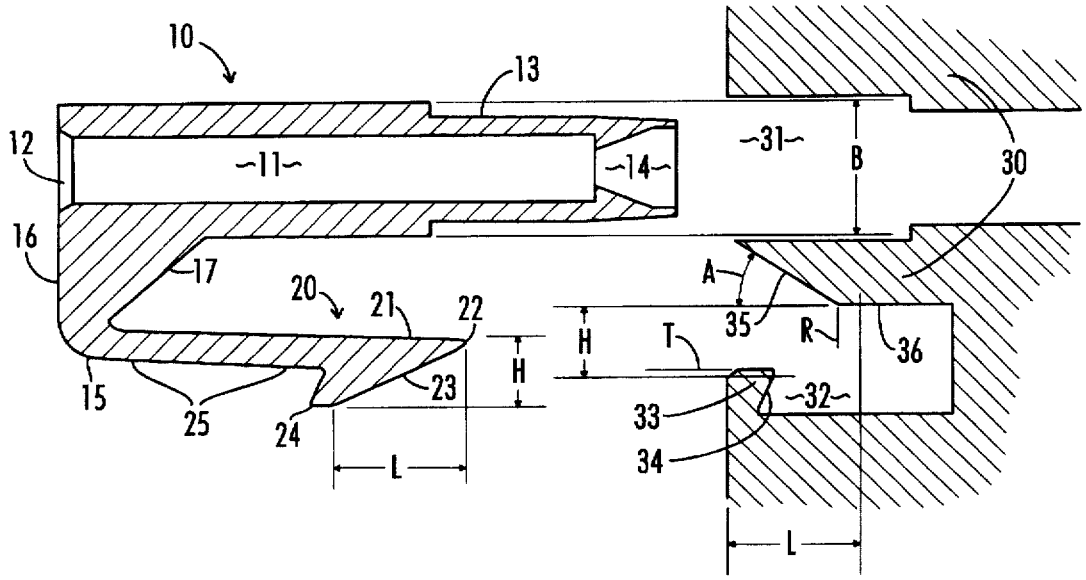
FIG. 1 is a longitudinal vertical section of one preferred embodiment of the external and internal half-connectors of our invention, before they are mated by insertion of the external half into the internal half.

As shown in FIG. 1, our invention advantageously employs an external half-connector 10 that is substantially the same in body 10, finger 13, bore 11-12-14 and hook 15-24 configuration as the related-art external half-connector discussed earlier. The internal half-connector 30, like that of the related art, also preferably includes an integrally molded mouth 31, throat, and adjacent barb-receiving chamber 32 with catch 33 to engage the barb 20 of the external body 10.

As in the related art, the mouth 31 of the internal body 30 is broad enough to receive the main body dimension B of the external body 10; and the internal-body throat accommodates the fingers 13 of the external body. Similarly the barb chamber 32 is long enough, behind the catch 33, to receive the entire barb 20; and the undercut faces of the barb and the catch are complementarily shaped and dimensioned.

Figure 16:
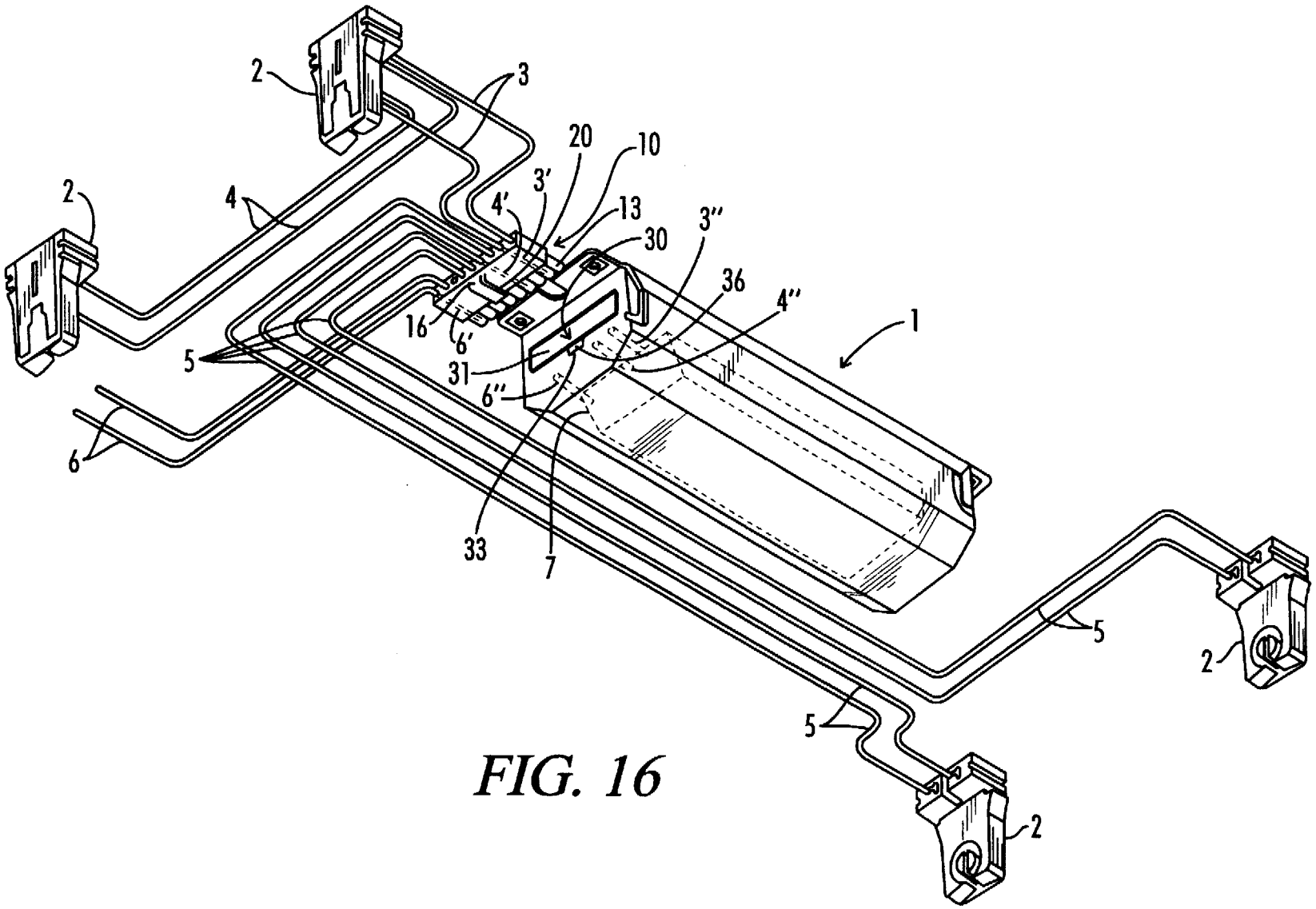
FIG. 16 is an isometric or perspective view showing the two connectors in their operating environment with attached luminaire leads and ballast.

The overall layout of FIG. 16 shows how these connector components are used as parts of a luminaire/ballast system. The ballast 1 contains electrical equipment 7, shown in the drawing in generalized diagrammatic form, which equipment is to be connected to luminaire leads 3–6.

The luminaire leads include some wiring 3, 4, 5 which extends to lamp sockets 2, and other wiring 6 which extends to a power source (not shown). The socket wiring 3, 4 is connected as to representative metallic contacts 3', 4' respectively, drawn schematically within the external half-connector 10; and the power wiring 6 is connected as to representative contact 6'—similarly drawn within that half-connector 10.

Within the ballast the electrical equipment 7 is connected to corresponding representative wires 3", 4", 6", which extend into the internal half-connector 30 from its back or inner end. At least the tips of these wires 3", 4" 6" are preferably bare, to serve as self-terminating contacts within that half-connector 30.

In practice the representative metallic contacts 3', 4', 6' preferably are first attached to terminate the corresponding leads 3, 4, 6 of the luminaire, and then installed and secured in the external half-connector 10. Of course the same procedures are performed for similar other contacts which, merely for purposes of clarity in the drawing, have been omitted from FIG. 16. Preferably the contacts are secured in the external half-connector 10 by the methods introduced in the above-mentioned earlier patent documents.

Within the ballast, not only the three representative leads 3", 4", 6" but also similar others, omitted from the drawing for clarity, likewise are in position for engagement with the corresponding contacts 3', 4', 6. The full connector 10–30 with its internal contacts thus completes electrical connections between the leads 3–6 of the luminaire and the electrical equipment 7 within the enclosure of the ballast 1.

All the illustrations in this document are to be regarded as only examples. In particular the present invention is not limited to such configuration of the half-connectors 10, 30 (FIG. 1) or the overall system (FIG. 16).

The preferred FIG. 1 system departs from that of the related art primarily in having a hook-retaining surface 36 with two main characteristics of interest:

(1) its vertical spacing above the top T of the catch 33 is less than the height H of the unstressed barb; and (2) the horizontal spacing between the front edge R of the retaining surface and the front face of the internal body 30 (and particularly the catch 33) is less than the length L of the unstressed barb ramp 23.

These conditions cooperate, as will be seen, to engage the hook and deter the hook from disengaging spontaneously—regardless of any reasonably likely deformation that may or may not be present. In the drawings, for purposes of clear illustration the first condition has been slightly exaggerated; in other words the interference is drawn proportionately larger than in the actual construction.

The second condition, in particular, is closely related to operation of the hook beam 25 as a double-supported spring, or double-supported deflecting beam. Such a beam has much greater resistance to transverse pressure applied by the catch 33 than a cantilevered spring has.

In addition the internal body 30 has a ramp 35, disposed at a shallow angle A upward and outward from the forward edge R of the retaining surface 36. In the drawings this ramp extends outward to a relatively sharp, feathered edge.

Also in the drawings the edge is very nearly flush with the forward face of the internal body 30, but this is not a necessary condition. The ramp 35 and lowered surface or ceiling 36 replace the thin partition 136 (FIG. 10) of the related art.

Figure 2:
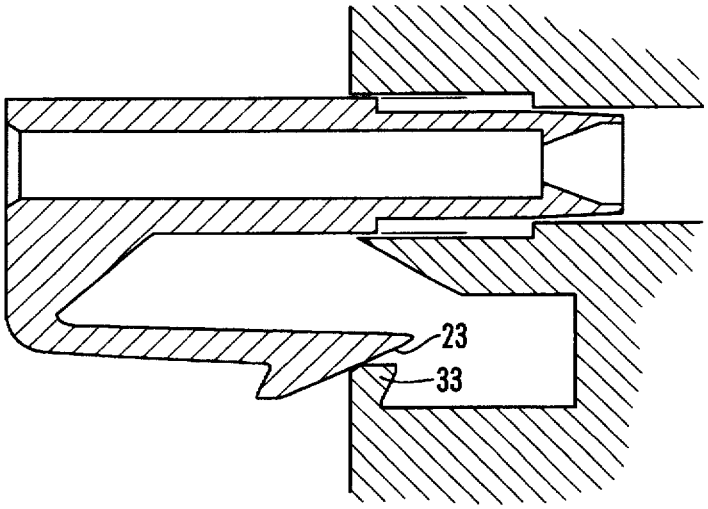
FIG. 2 is a like view of the same two half-connectors, but at a first stage in the insertion process—in which the hook first contacts the catch.
Figure 10:
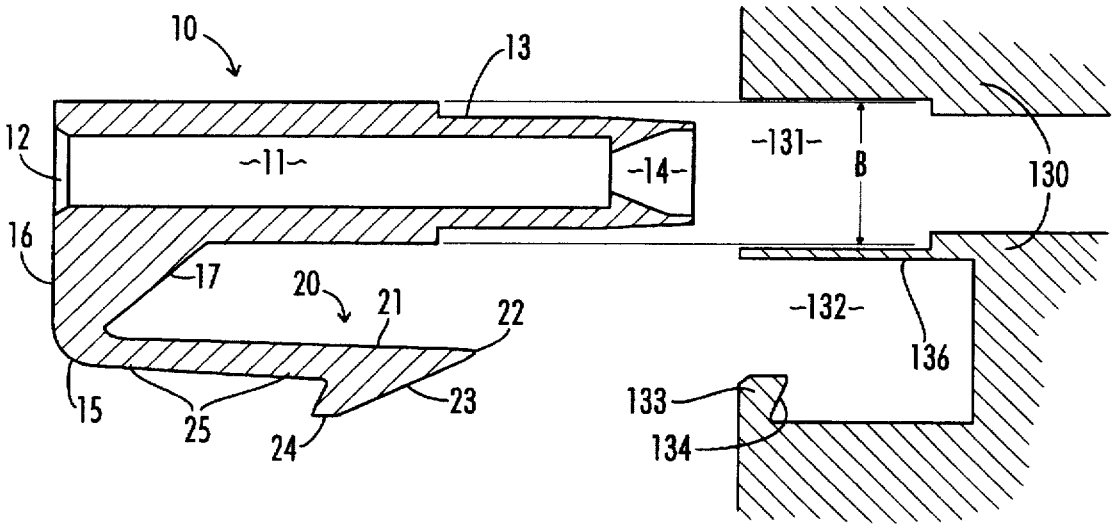
FIG. 10 RELATED ART
FIG. 10 is a view like FIG. 1 of the same external half-connector, but in conjunction with an internal half-connector of the related art as described in the "RELATED ART" section of this document.
Figure 11:
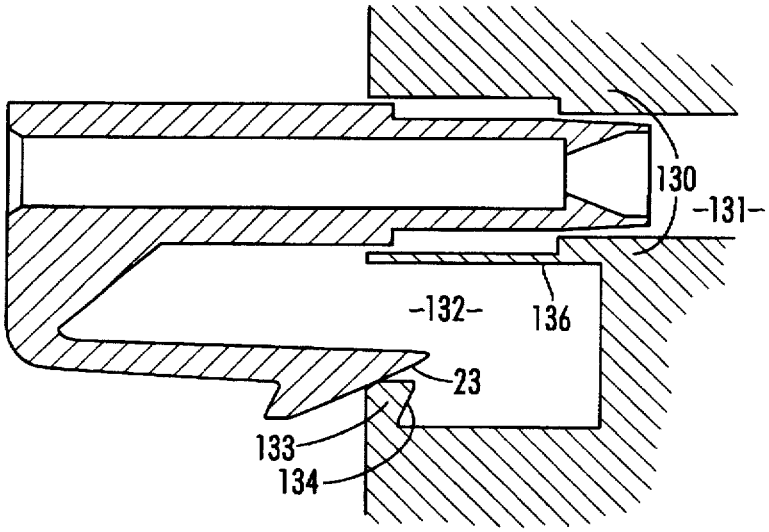
FIG. 11 RELATED ART
FIG. 11 is a view like FIG. 2 but of the same two half-connectors as in FIG. 10.
Figure 12:
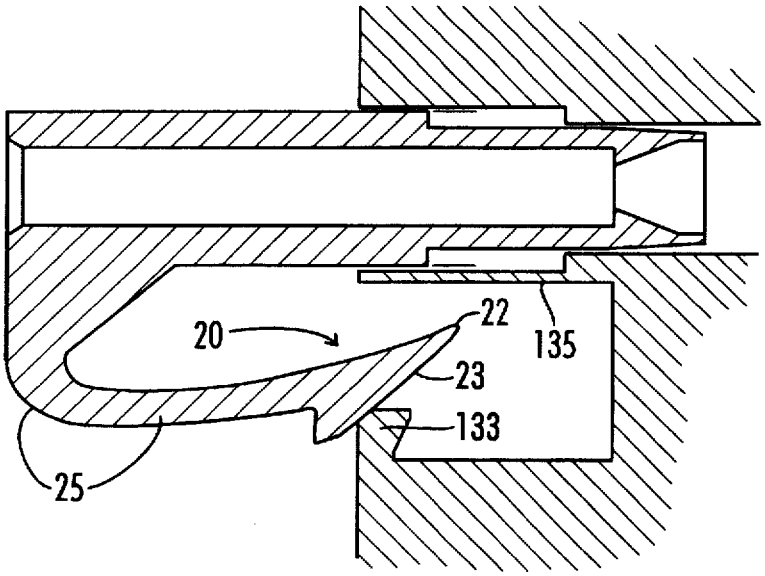
FIG. 12 RELATED ART
FIG. 12 is a view like FIG. 3 but of the same two half-connectors as in FIGS. 10 and 11.

If the hook 15–25 is in its substantially nominal condition as shown in FIG. 1, then the initial phases of operation are substantially as in previously discussed FIGS. 10 through 12 of the related art. That is, when the external body 10 is advanced toward engagement with the internal body 30, the first contact (FIG. 2) is between the cam 23 of the barb 20 and the rounded outer top corner of the catch 33; then with further advancement the cam 23 rides upward (FIG. 3) onto that rounded corner.

Figure 3:
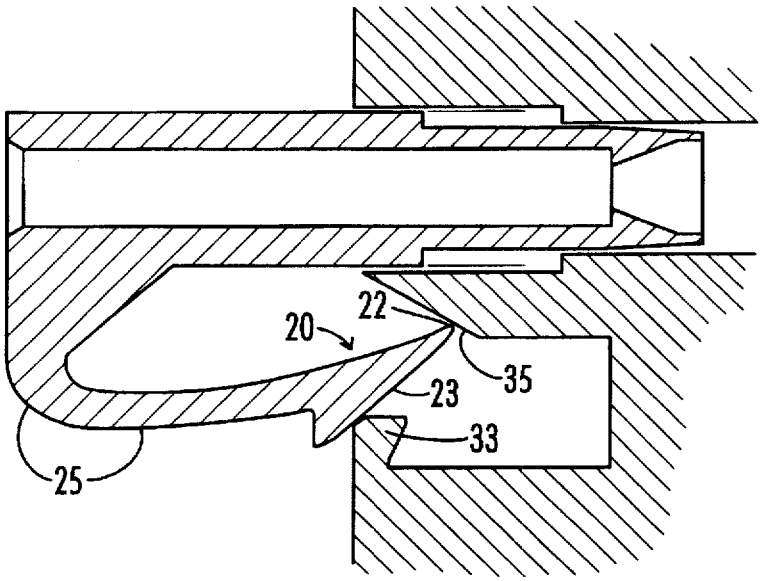
FIG. 3 is a like view of the same two half-connectors, but at a second stage of insertion—in which the cam of the hook barb is riding up the outer corner of the catch.

As FIG. 3 shows, however, operation at this juncture diverges from that of the related art, as the barb tip 22 impinges on the ramp 35. Still further insertion forces the tip 22 to ride down along the ramp 35—and forward, further into the interior of the barb-receiving chamber—as the cam 23 continues to ride up the outer corner of the catch 33.

(FIG. 3 may suggest that the barb tip 22 will instead jam against the ramp 35. As mentioned earlier, the interference has been exaggerated in these drawings, and in particular for purposes of illustration the height of the ramp 35 relative to the thickness of the related-art partition 136 is significantly exaggerated. These exaggerations somewhat interfere with accurate showing of the angles and other spatial relationships in the intermediate positions of FIGS. 3, 4a and 4. In actuality the overall ramp height is roughly two to 2½ millimeters—not more than roughly twice the related-art partition thickness of one to 1¾ mm.)

With yet further insertion the tip 22 traverses the obtuse angle at the bottom of the ramp and begins to ride instead along the horizontal ceiling 36 (FIG. 4a)—or possibly to slightly tuck under that ceiling (FIG. 4) as the top surface 21 of the barb rides along the edge-angle that separates the ramp 35 from the ceiling 36. Which of these alternatives actually occurs is dependent on the exact dimensional relationships, forces, speeds, surface conditions etc.

Figure 4:
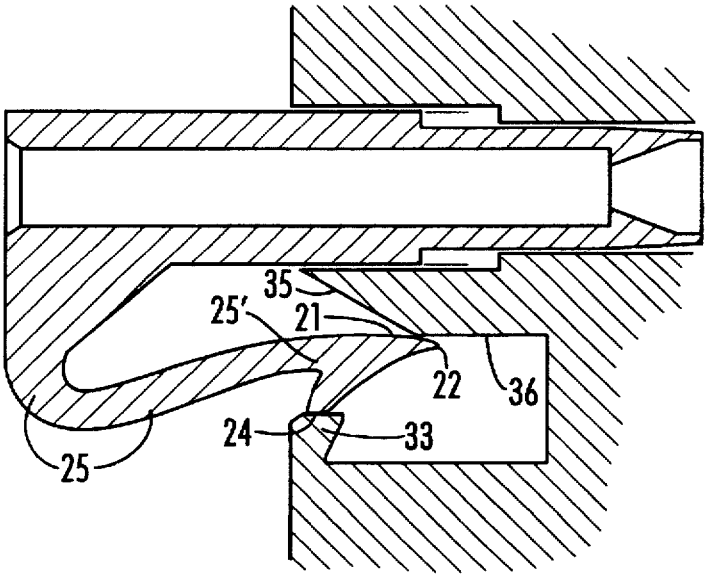
FIGS. 4*a* and 4 are like views of the same two half-connectors, but at a third stage of insertion—in which the barb and beam are deforming or "deflecting" to allow passage catch and restraining surface.
Figure 4A:
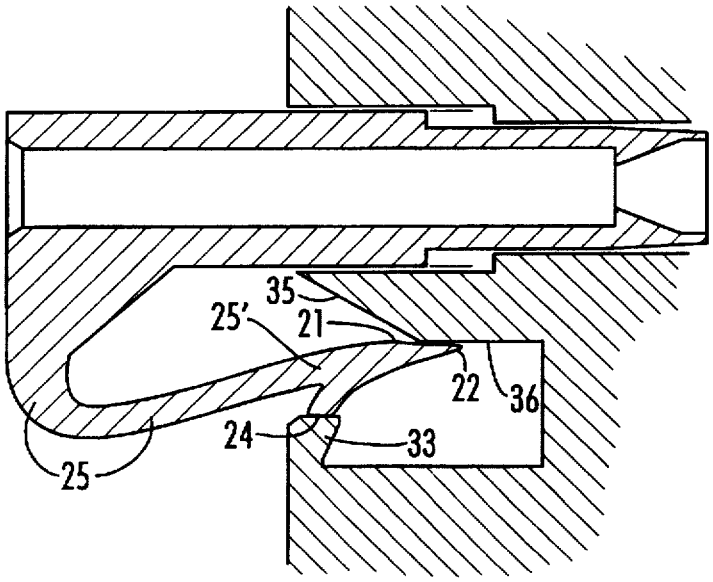

FIGS. 4a and 4 may be regarded as alternative visualizations of the same stage of advancement of the external body. As will be appreciated, precise prediction or actual observation of these small and somewhat inaccessible elements is awkward.

Both these views show in common, however, the important characteristic that the beam 25 is in effect suspended between its root support 15 (FIG. 1), at the remote outer end of the beam, and the ceiling/barb 36–22 or 36–21 impingement at or near the innermost end within the barb chamber. In this condition the beam (or "beam spring") 25 is thus double-suspended against transverse force applied by the top of the catch 33 against the barb heel 24—and is deflected (upward in the drawings) by that transverse force.

This is in consequence of the second dimensional relationship mentioned above in connection with FIG. 1, and represents a departure from the always-cantilevered-spring operation of the related art. The double-suspended spring presents a much higher effective spring constant, with respect to restoring force opposing the transverse force from the catch.

With further insertion the barb heel 24 passes the inner top corner of the catch, so that the rear undercut surface of the heel 24 can clear the inward undercut surface 34 of the catch. The resulting condition illustrated in FIGS. 5a and 5 of course can exist only instantaneously, as the hook begins a downward snapping action suggested by the arrows S. Here too FIGS. 5a and 5 are alternative visualizations of this same phase of insertion, depending on the angles, speeds and other conditions with which this particular momentary state is approached.

Figure 6:
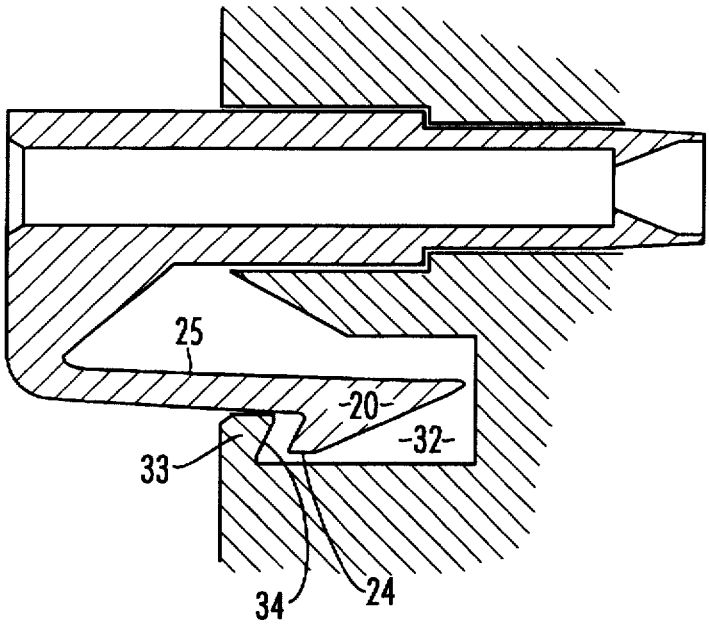
FIG. 6 is a like view of the same two half-connectors, but in a quiescent state following insertion.
Figure 13:
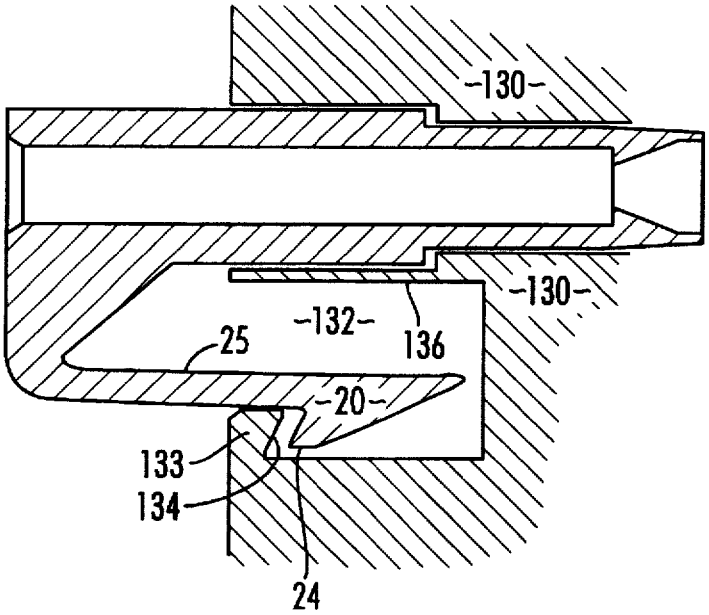
FIG. 13 RELATED ART
FIG. 13 is a view like FIG. 6 but of the same two half-connectors as in FIGS. 10 through 12.
Figure 14:
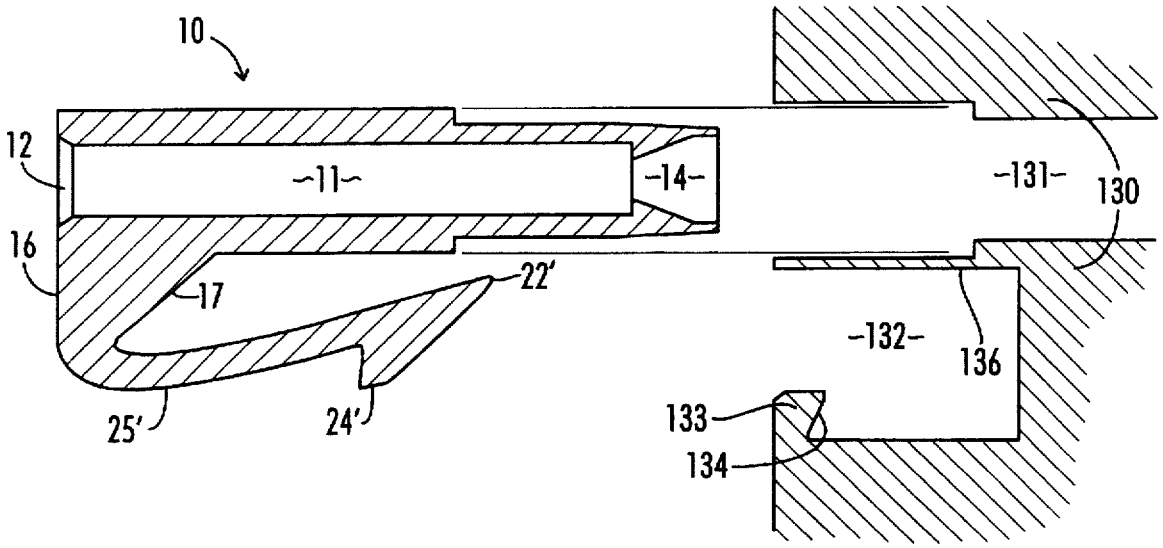
FIG. 14 RELATED ART
FIG. 14 is a view like FIG. 7 but of the same two half-connectors as in FIGS. 10 through 13.
Figure 15:
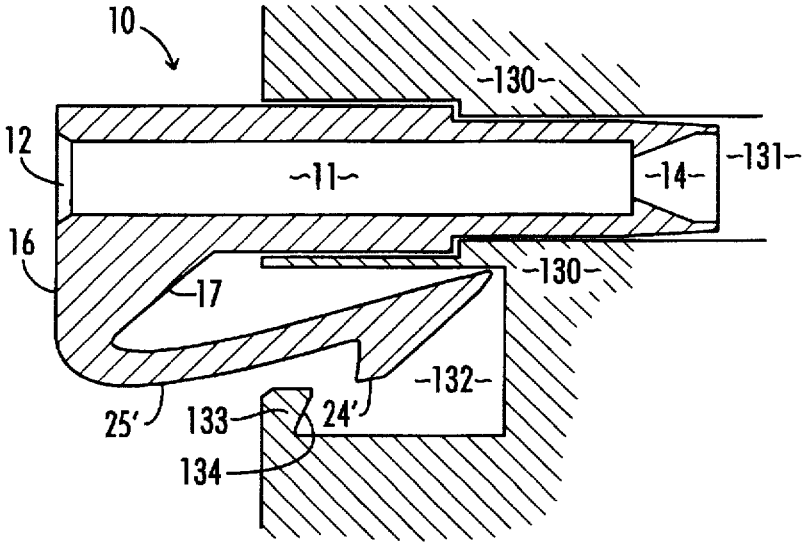
FIG. 15 RELATED ART
FIG. 15 is a view like FIG. 9 but of the same two half-connectors as in FIGS. 10 through 14.

The hook then may bounce on the top surface of the catch, but eventually comes to rest (FIG. 6) in a quiescent condition, nominally resting on and biased as a simple cantilevered spring against the top surface of the catch—very much as in FIG. 13 for the related art. In this condition the resistance to initiation of accidental separation of the two half-connector bodies is quite high, generally as described earlier for the related art.

Even if somehow such accidental separation is initiated, however, with the novel configuration of the present invention the resistance to continuation of the separation becomes much higher. This fact can be seen in two ways, first by considering what must be done when a user wishes to deliberately disconnect the connector.

Figure 5:
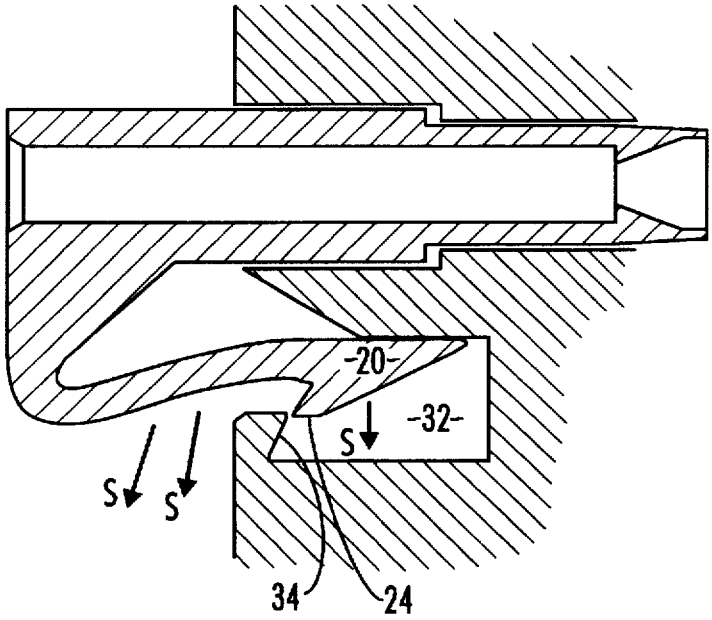
FIGS. 5*a* and 5 are like views of the same two half-connectors, but at a fourth stage of insertion—in which the barb has passed fully through the undersize vertical spacing just mentioned.
Figure 5A:
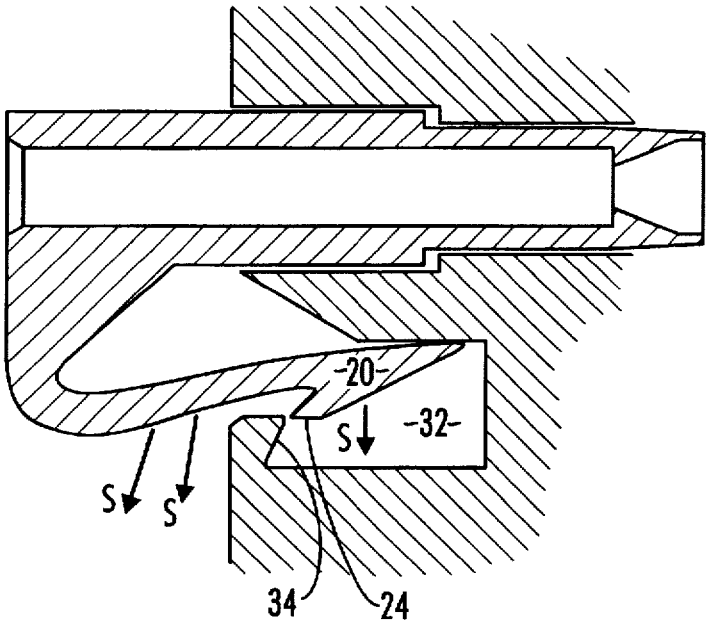

To disengage the two half-connector bodies, a user pinches (i. e. manually, directly deflects) the beam up to the condition shown in FIGS. 5a and 5, and then preferably a bit further, so that the heel of the beam more cleanly clears the top of the catch. Then the user pulls the external body straight out to unplug the connector.

During this operation too the beam operates as a double-end-supported device. Thus the hook is better guarded—by higher retention forces—against accidental extraction than in the cantilevered-spring case.

A second indication of how much more strongly the present system resists accidental disconnection can be obtained by recalling that such separation can occur only if the system in some other way passes back through, or somehow circumvents, the intermediate double-end-supported-beam condition of FIGS. 4a and 4. In that intermediate condition the effective spring constant is elevated.

In particular this may be appreciated by considering what happens if the hook 16–25 is initially warped. That situation is analyzed below.

Figure 7:
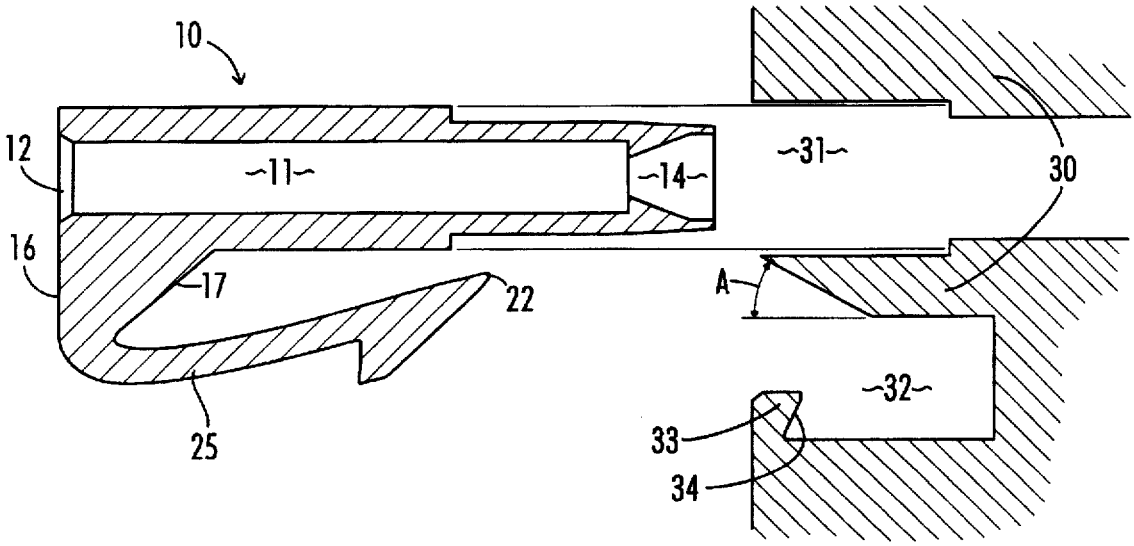
FIG. 7 is a view like FIG. 1 but with a hook that has been warped away from its nominal design configuration and thereby folded up toward the underside of the external half-connector body proper.
Figure 8:
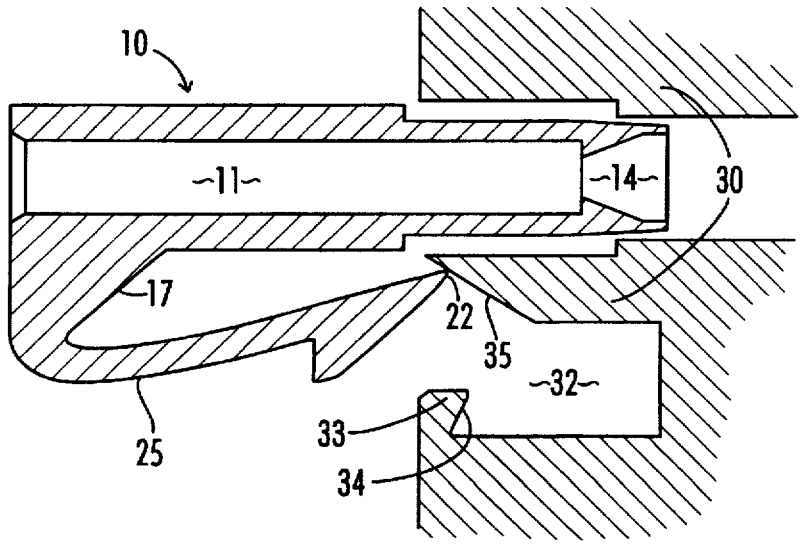
FIG. 8 is a view like FIG. 2, but showing the deformed hook of FIG. 7.

Operation of the present system is dramatically different from that of the related art when the hook 16–25 is predeformed upward (FIG. 7) toward contact with the underside of the external body 10 proper. Now when the hook is advanced its tip 22 is scooped (FIG. 8) away from the body 10 by the ramp 35.

The tip 22 then rides downward along the ramp until the condition of the parts closely approximates that of the nominal case in FIG. 3. In other words, the two different starting situations temporarily converge at that stage, and with further insertion the hook then passes through the double-suspended beam phase of FIGS. 4*a* and 4.

Figure 9:
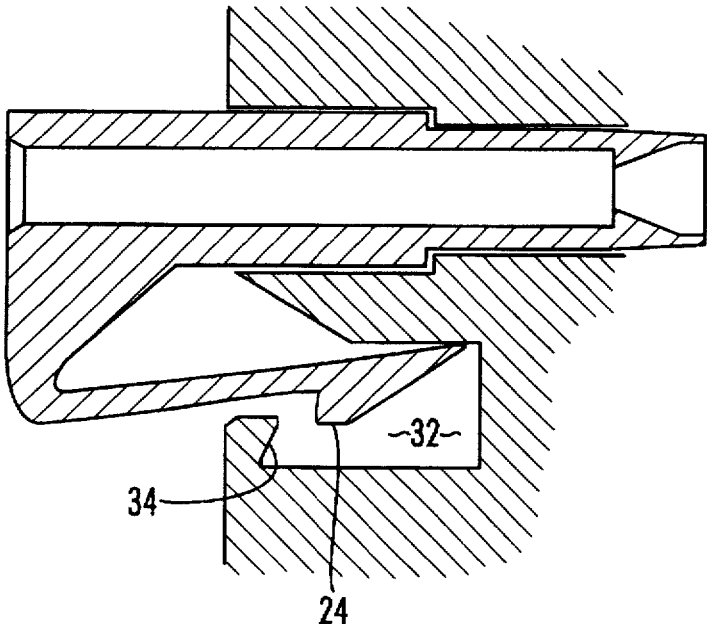
FIG. 9 is a view like FIG. 6, but showing the deformed hook of FIGS. 7 and 8.

Thereafter, rather than snapping downward and remaining down the predeformed hook comes to rest (FIG. 9) biased upward against the ceiling. Because of the interference relationships described earlier, the barb 20 cannot escape from its chamber 32—unless a user pinches the beam upward so that the barb can clear the catch as in the nominal case.

In event light extraction forces (without such user-performed pinching) tend to withdraw the barb from the chamber 32, the matching undercut surfaces tend slightly to oppose such extraction, pulling the heel 24 instead further downward along the catch interior surface 34.

Figure 9A:
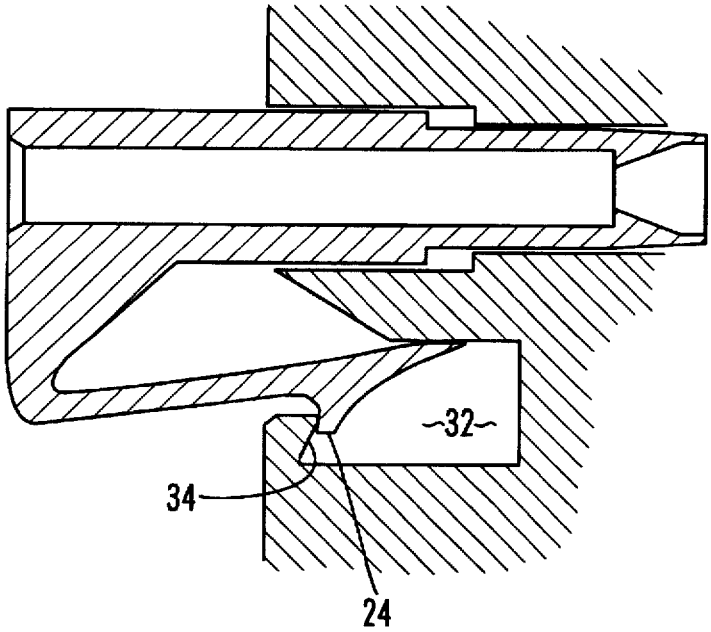
FIG. 9*a* is a view related to FIGS. 7 through 9, but showing counterdeformation of the deformed hook of those drawings to resist separation force.

If insertion forces become heavier, the barb—rather than slipping out—tends to deform and jam crosswise (FIG. 9*a*) of the chamber opening. This anchoring configuration, particularly as compared with prior-art and related-art systems in which components have deformed away from the nominal geometry, is relatively quite stable and sturdy.

This configuration represents another way in which the double-deflecting-beam-spring configuration, discussed above, leads to much higher resistance against accidental separation than the cantilevered-spring geometry of the related art.

In summary, the double-supported spring ensures positive locking or latching. As will now be clear to those of ordinary skill in the art, the relationship between insertion and extraction forces can be adjusted as desired by controlling key parameters, listed below with approximate values which we prefer to employ in one preferred embodiment:

| | mm | inch |
|---|---|---|
| barb cam 23: | | |
| length | 5 | 0.2 |
| angle | 31° | |
| ramp 35: | | |
| height | 2 to 2½ | 0.08 to 0.10 |
| angle A | 30° | |
| rear undercut face of the barb: | | |
| height | 1½ | 0.06 |
| beam 25: | | |
| thickness | 1 | 0.04 |
| relationship between the barb-receiving-chamber aperture and the overall barb height H (Fig. 1): | | |
| interference | 0.2 | 0.007 |

We have found that the novel configuration of FIGS. 1 through 9*a* provides improved performance, purely as a practical matter and independent of any theory or analytical understanding of its operation. Neither the present invention nor its advantageous character depends upon correctness of any such theoretical development.

Hence our invention is fully accessible and amenable to successful practice by persons of ordinary skill in the art. This is of course particularly so in view of the foregoing enumeration of dimensions and angles.

Nevertheless, for the further understanding of those readers who may be familiar with engineering mechanics, we mention here that the second-moment-area theorem gives the force W required to produce a given deflection f as $$W=k\cdot fEI/l^3,$$

where

E=modulus of elasticity,

I=second moment of inertia (taking account of the beam thickness), l=length of the beam;

and the constant form factor $$\underline{k} = 3 \text{ for a cantilevered beam, or}$$
$$= 48 \text{ for a double-end-supported beam.}$$

Hence predicted extraction force for the present invention is 48÷3=16 times greater than for a like-dimensioned cantilever device of the related or prior art.

It will be understood that the foregoing disclosure is intended to be merely exemplary, and not to limit the scope of the invention—which is to be determined by reference to the appended claims.

What is claimed is:

1. In combination, for use in a fluorescent-lamp fixture having lamp sockets:

a ballast;

electrical equipment mounted within the ballast;

a first half connector mounted to the ballast and connected electrically to the electrical equipment;

electrical leads for extension through said fixture substantially outside the ballast;

a second half-connector, terminating said electrical leads, for mating with the first half-connector to complete electrical interconnections between the electrical equipment and the electrical leads;

a hook extending from the first half-connector, the hook having a beam portion;

a catch, formed in the second half connector, for engaging the hook to hold the first and second half-connectors together; and a hook retaining surface, also formed in the second half-connector, for holding the hook engaged with the catch so that during insertion or removal of the hook the hook retaining surface contacts a top surface of the hook near a tip of the hook and deflects the top surface of the hook near the tin of the hook downward with respect to the beam portion of the hook.

2. The combination of claim 1, wherein:

the hook comprises a beam with a generally longitudinal extension, and a barb with an unstressed dimension generally transverse to the longitudinal extension;

the restraining surface is spaced from the catch, along a direction transverse to the generally longitudinal extension of the beam, by a distance that is smaller than the transverse unstressed dimension of the barb.

3. The combination of claim 2, wherein:

the hook deflects for passage of the barb between the catch and the restraining surface.

4. The combination of claim 3, further comprising:

a ramp also formed in said second one of the two half-connectors, for helping to guide the barb into alignment with the restraining surface.

5. The combination of claim 2, further comprising:

a ramp also formed in said second one of the two half-connectors, for helping to guide the barb into alignment with the restraining surface.

6. The combination of claim 1, further comprising:

the fluorescent-lamp fixture, including lamp sockets, interconnected with at least some of said electrical leads.

7. The combination of claim 1 wherein the restraining surface cooperates with said first one of the two half-connectors to support the hook as a double-supported deflecting beam against lateral forces applied to the hook by the catch during engagement of the hook and catch.

8. The combination of claim 1, wherein:

the restraining surface is offset, along a generally longitudinal direction, from the catch;

the hook has an enlarged portion that mates with the catch; and at least a part of the hook bows to enable the enlarged portion to pass the catch.

9. In combination, for use in a fluorescent-lamp fixture having lamp sockets:

a ballast;

electrical equipment mounted within the ballast;

a first half connector mounted to the ballast and connected electrically to the electrical equipment;

electrical leads for extension through said fixture substantially outside the ballast;

a second half-connector, terminating said electrical leads, for mating with the first half-connector to complete electrical interconnections between the electrical equipment and the electrical leads;

a hook extending from the first half-connector, along a longitudinal direction between the first and second half-connectors;

a catch, formed in the second half connector, for engaging the hook to hold the first and second half-connectors together; and a hook retaining surface, also formed in the second half-connector, for cooperating with said first half-connector to support the hook as a double-supported deflecting beam, against lateral forces applied to the hook by the catch during engagement of the hook and catch, and said hook retaining surface, during insertion and removal of the hook, contacts a top surface of the hook near a tip of the hook and deflects the top surface of the hook near the tip of the hook downward with respect to the beam portion of the hook.

10. The combination of claim 9, further comprising:

a ramp also formed in said second one of the two half-connectors, for helping to guide the hook into alignment with the cooperating surface.

11. The combination of claim 9, further comprising:

said fluorescent-lamp fixture, including lamp sockets interconnected with at least some of said electrical leads.

12. The combination of claim 9, wherein:

the cooperating surface and the catch are offset, along the longitudinal direction, and are also separated in a direction transverse to the longitudinal direction; and to engage the hook with the catch, the hook is inserted, generally along the longitudinal direction, between the catch and the surface.

* * * * *